United States Patent [19]

Wilcox

[11] Patent Number: 4,913,675

[45] Date of Patent: Apr. 3, 1990

[54] MISSILE HELICOPTER DEVICE

[76] Inventor: Thomas R. Wilcox, 109 Wellington Ave., Short Hills, N.J. 07078

[21] Appl. No.: 176,950

[22] Filed: Apr. 4, 1988

[51] Int. Cl.[4] ..... A63H 27/12

[52] U.S. Cl. ..... 446/36; 446/63; 446/65

[58] Field of Search ..... 446/34, 36, 45, 56, 446/61, 62, 63, 64, 65; 102/339, 348, 388

[56] References Cited

U.S. PATENT DOCUMENTS

| | | | |
|---|---|---|---|
| 1,880,586 | 10/1932 | Tiling . | |
| 2,044,819 | 6/1936 | Taylor | 102/2 |
| 2,145,972 | 2/1939 | Clark et al. | 446/63 X |
| 2,380,278 | 7/1945 | Weissman | 244/138 |
| 2,746,207 | 5/1956 | Starkey | 446/45 |
| 2,753,657 | 7/1956 | Taggart . | |
| 3,098,445 | 7/1963 | Jackson | 102/348 X |
| 3,113,398 | 10/1963 | Merritt | 446/64 X |
| 3,119,196 | 1/1964 | Alberico . | |
| 3,188,768 | 6/1965 | Boswell | 446/45 |
| 3,643,599 | 2/1972 | Hubich | 102/388 |
| 3,730,099 | 5/1973 | Schopp | 102/339 |
| 3,826,037 | 7/1974 | Migowski . | |
| 3,839,818 | 10/1974 | Heggedal | 446/62 |
| 3,903,801 | 9/1975 | Senoski | 102/34.1 |
| 4,295,290 | 10/1981 | Boswell | 446/45 |
| 4,634,394 | 1/1987 | Massey | 446/36 |

FOREIGN PATENT DOCUMENTS

| | | | |
|---|---|---|---|
| 653658 | 5/1951 | United Kingdom | 446/36 |
| 833895 | 5/1960 | United Kingdom | 446/45 |

*Primary Examiner*—Robert A. Hafer
*Assistant Examiner*—Sam Rimell
*Attorney, Agent, or Firm*—Kenneth P. Glynn

[57] ABSTRACT

The present invention is a missile-helicopter device which is capable of a projected, nose up ascent and a helicopter nose up descent. The device has an elongated missile body, fins, a latch release for the fins, bias mechanism for the fins and propulsion. The fins have relatively long lengths and short widths and are hingedly connected to the upper half of the missile body. The fins have a first position which is a substantially vertical position along their lengths parallel to the elongated missile body such that the fins protrude along their widths radially outwardly from the missile body at least at the lower half of the missile body so as to function as flight stabilizing fins during ascent. They also have a second position which is at approximately right angles or larger to the missile body such that the fins protrude radially outwardly along their lengths away from the upper half of the missile body so as to create a nose up helicopter type rotation during descent.

10 Claims, 3 Drawing Sheets

MISSILE HELICOPTER DEVICE

BACKGROUND OF THE INVENTION

1. Field of the Invention

The present invention is directed to a launched projectile which functions as a fin-stabilized missile in its ascent and as an air propelled helicopter in its descent. Uniquely, the present invention device ascends and descends while remaining in the nose-up position and a single set of fins stabilize the ascent in a first position and act as helicopter type blades during the descent.

2. Prior Art Statement

The prior art is replete with toy and other projectile devices which are launched as missiles or rockets and descend in a helicopter fashion.

For example, U.S. Pat. Nos. 1,880,586 and 3,826,037 describe vertically launched projectiles with fins that change position at the top of an ascent so as to become blades or propellors to create a descent like a helicopter. These, however, turn the missile around so that the nose faces down and hits the earth first, on descent.

U.S. Pat. Nos. 2,753,657 and 3,119,196 describe airflight devices which are shot upward in a closed position and open for descent to simulate a helicopter. They do not, however, involve rockets or missiles and do not have an initial arrangement of fins around a body. They do teach the basic concept, long recognized in the field, that closed blades can be shot up, opened and cause helicopter type descent.

U.S. Pat. Nos. 2,044,819 and 2,380,278 teach bomb type missiles which have copter blades held flat against the missile body during propulsion and open for copter type descent. These devices do allow for nose-up ascent and descent but stabilizing fins are not included during ascent.

U.S. Pat. No. 3,903,801 describes a model rocket which is shot and, when maximum altitude is reached, a nose cone is ejected, blades on a central rod rise out of the rocket tube, open up and cause a helicopter type descent. This reference does show a method of having a missile ascend and descend in the nose up position, but requires separate stabilizer fins, blade storage in the missile body and a cone ejection mechanism.

Thus, the prior art is replete with early and recent patents teaching various types of helicopter descendible missiles yet none describe the present invention device involving the use of the same fins as vertical stabilizer ascent fins and nose up helicopter descent blades.

SUMMARY OF THE PRESENT INVENTION

The present invention is directed to a projectile which may be characterized as a missile helicopter device which is capable of a projected, nose up ascent and a helicopter nose up descent. The device comprises an elongated missile body, a plurality of fins, latch release means for the fins, bias means and propulsion means. The elongated missile body has a nose at its top end and has a base at its bottom end and is generally divided into an upper half and a lower half. The plurality of fins have relatively long lengths and short widths and are hingedly connected to the upper half of the missile body. The fins have a first position which is a substantially vertical position along their lengths parallel to the elongated missile body such that the fins protrude along their widths radially outwardly from the missile body at least at the lower half of the missile body so as to function as flight stabilizing fins during ascent. They also have a second position which is at approximately right angles or larger to the missile body such that the fins protrude radially outwardly along their lengths away from the upper half of the missile body so as to create a nose up helicopter type rotation during descent. The latch release means is located on the side of the missile body and includes a releasable hold mechanism on the plurality of fins to hold them in the first position during ascent and to release them into the second position at about the time of descent. The bias means is located on the missile body and connected to each of the fins so as to bias the fins into the second position upon release by the latch release means. The propulsion means may be any known propulsion for firing toy or hobby or other type of missile projectiles.

BRIEF SUMMARY OF THE DRAWINGS

The present invention will be more fully understood as described herein when this specification is taken in conjunction with the drawings attached hereto, wherein.

DETAILED DESCRIPTION OF THE INVENTION AND DRAWINGS

As mentioned in the prior art statement above, there are numerous missiles and other type of projectiles which will helicopter down to the ground based on the broad concept of fins "opening up" to rotate the projectile on descent. However, the present invention uniquely provides simultaneously for both stabilizing fins during ascent and helicopter blades during descent using the same set of fins and does so in such a manner as to permit nose up descent. Nose up descent may be desirable for various applications, such as in a toy where a soft landing simulation is desired or in a surveillance rocket where a miniature camera is utilized and nose up stability is required for both ascent and descent. Other types of applications where nose up descent may be desirable are within the skills of the artisan.

Figure 1:
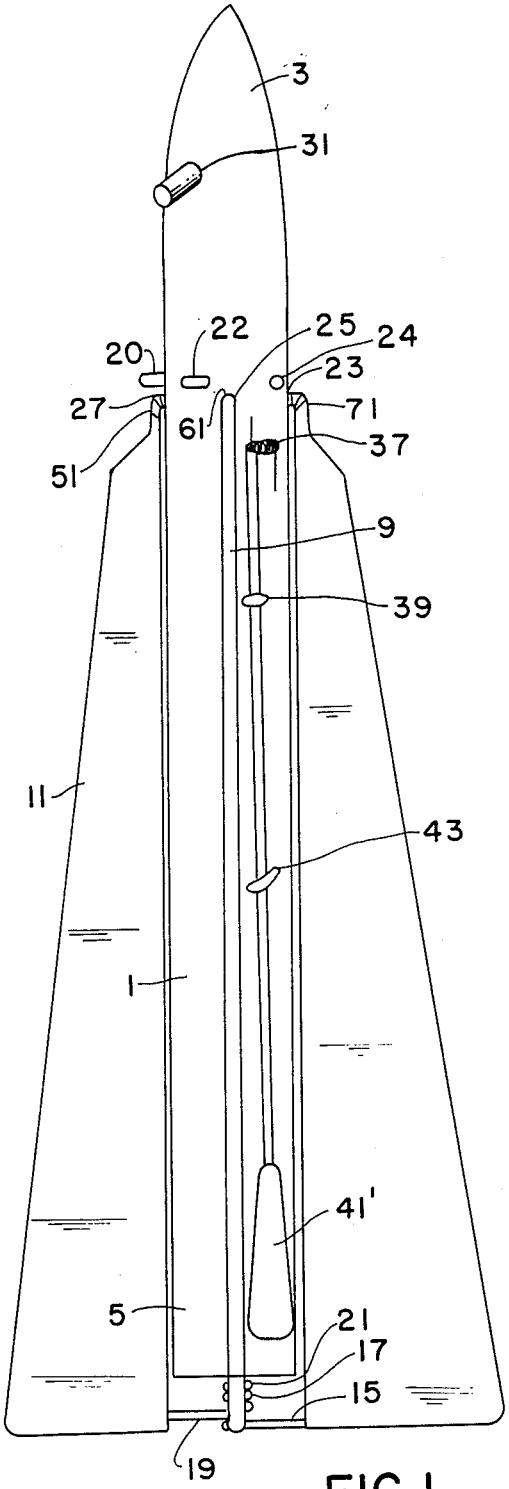
FIG. 1 is a side view of a preferred missile helicopter device for the present invention.
Figure 5:
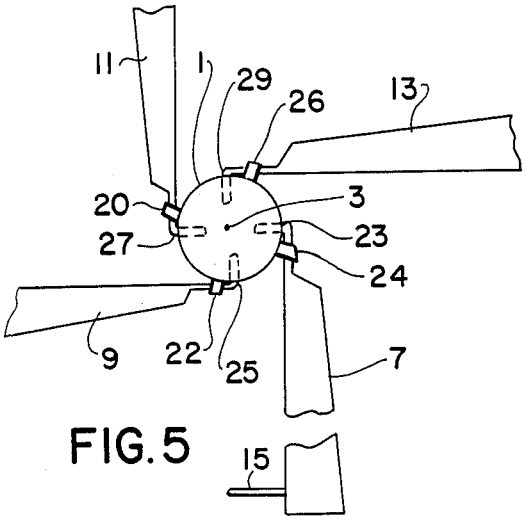
FIG. 5 shows a top view of a present invention device with its fins extended to the helicoptering second position; and, FIG. 6 shows a side view of a solid fuel type missile helicopter device of the present invention.

Referring now to FIG. 1, there is shown generally a present invention missile helicopter device having an elongated missile body 1 with a nose 3 and a base 5. The nose 3 is at the upper half of missile body 1 and the base 5 is at the lower half of missile body 1. A plurality of fins 7, 9 and 11 (fin 13 is referred to in conjunction with FIGS. 3 and 5 and is behind missile body 1 as shown in FIG. 1) are hingedly connected to the upper half of missile body 1 at connecting points 23, 25 and 27 respectively. The plurality of fins have a first position which is shown in FIG. 1 and which is substantially vertical along the lengths of the fins and parallel to the elongated missile body 1, as shown. Thus, the plurality of fins 7, 9 and 11, as shown in FIG. 1 are not only parallel to the elongated missile body 1 but the fins protrude along their widths outwardly and radially from missile body 1 at least at the lower half of missile body 1, and, in this embodiment, for a significant portion of the entire length of missile body 1. Thus, in this first position, fins 7, 9 and 11 will function as flight stabilizing fins during ascent.

The plurality of fins 7, 9 and 11 (and it is understood that these statements would also apply to fin 13 not shown in FIG. 1) have a second position which occurs when fins 7, 9 and 11 rotate upwardly about connection points 23, 25 and 27 so as to swing up into at least a horizontal position and perhaps any position which is greater than a right angle as measured from the protruded, second position fins to the missile body 1. This angle is defined using stops 20, 22, 24 and 26 perpendicular to the tangent of body 1, respectively.

In this particular embodiment, each of the fins 7, 9 and 11 have connecting hooks 15, 17 and 19 (as well as 21 which would be the connecting hook for fin 13 not shown) and these are located below the base 5 of missile body 1 as shown. It cannot be seen in FIG. 1 but these hooks are, in the fins' first position, hooked onto a vertical rod which is located behind the bottom part of fin 9 below the base 5. Located at connecting points 23, 25 and 29 are bias means 51, 61 and 71 which, in this case are springs. An example of this arrangement is described in more detail in conjunction with FIG. 2 below.

FIG. 1 also shows a portion of the latch release means which, in this case is a drag lever 41' located under hook 43 as well as internal aspects not shown in this embodiment. The drag lever 41 is hinged at spring hinge 37 providing movement away from missile body 1 as aerodynamic pressures decrease at the peak of flight. Launch means 31 in this case is a projection hook which enables the device to be launched from a catapult type mechanism such as a tube, sling shot or other catapult type launch which may be spring driven or elastic belt driven. However, the particular launch mechanism is not critical and many alternative launch techniques could be used, e.g. pressurized fluids, solid or liquid fuels, etc.

Figure 2:
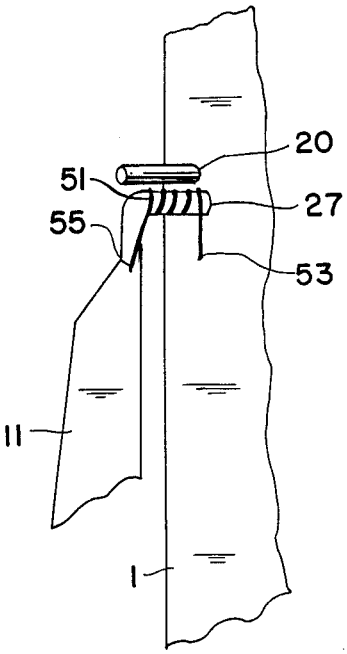
FIG. 2 is a partial side view of a portion of the missile body and a portion of one fin of a present invention device.

Referring now to FIG. 2, there is shown a partial view of missile body 1 and nose 3 as well as a blow-up of a portion of fin 11, connecting point 27, spring 51 and stop 20. The spring 51 is wound around the extending portion of fin 11 and is anchored onto fin 11 at point 55 and onto missile body 1 at point 53. Thus, spring 51 is wound so as to bias and push the fin 11 upwardly into the horizontal position upon release of the latch release means. This occurs at the top of ascent and it is the springs such as spring 51 which biases the fins into the helicopter descent mode. Stop 20 halts the upward rotation of the fin in the descent position for the helicopter mode.

Figure 3:
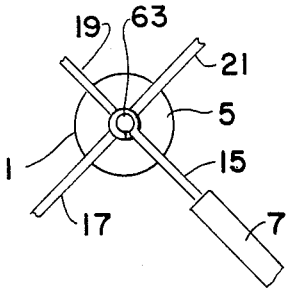
FIG. 3 represents a bottom view showing the extended portion of a latch release means of a present invention device looking up at the base of the missile body.

FIG. 3 shows the bottom of base 5 of missile body 1. Vertical rod 63 is shown at its bottom, protruding out of base 5. Wrapped about vertical rod 63 are fin connection hooks 15, 17, 19 and 21. These are connected to the bottoms of the fins as mentioned above in conjunction with FIG. 1 and the fins are not shown for simplicity. Basically when vertical rod 63 is lifted upward, hooks 15, 17, 19 and 21 are released and due to the bias means on the fins to which they are connected, the fins will rotate upwardly from their first position to their second position. The release of hooks 15, 17, 19 and 21 by the lifting of vertical rod 63 is more clearly shown in FIG. 4.

Figure 4:
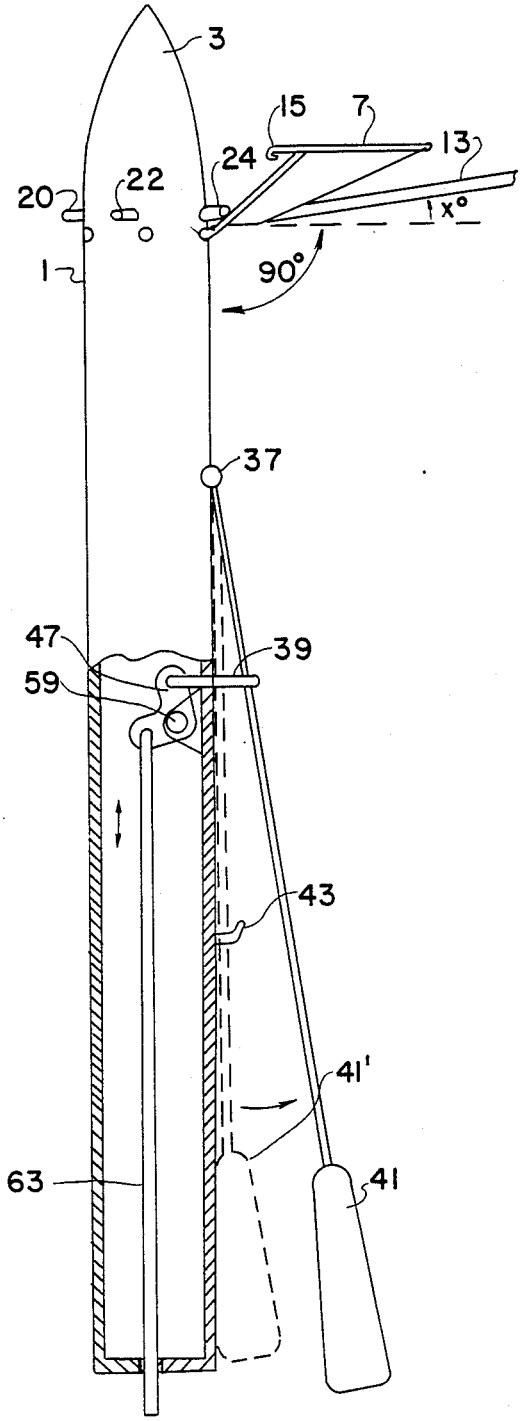
FIG. 4 shows a side view which has some fins missing and their bias means missing and shows a partial cut section of the missile body to reveal a detail of one preferred embodiment of the latch release means used in the present invention.

Referring now to FIG. 4, it should be noted that this represents a side partially cut view of missile body 1 which is shown in FIG. 1 but excludes two of the fins and, for simplicity, excludes the spring mechanism described in conjuction with FIG. 2. Also, this FIG. 4 shows the fins 7 and partial fin 13 in their second position for helicopter type descent. As can be seen fins 7 and 13 are at least approximately horizontal, ie at right angles or 90 degree to missile body 1 and, to enhance the helicoptering effect, are slightly greater than right angle by X° wherein X could be five, ten or fifteen degrees or so. The exact angle is not critical and preferred helicoptering angles are well known to the artisan.

Also in FIG. 4 is drag lever 41 in the open position and, by dotted lines, 41' in the closed position. The hinge point for drag lever 41 is spring hinge 37. Referring to FIGS. 1 and 4, drag lever 41' is in the closed position behind hook 43 in FIG. 1 prior to launching. At the time of launching, the aerodynamic forces along the missile body 1 push down on the fin end of 41' and, since it is slightly twisted to move away from hook 43, is now loosely floating but being pressed in toward missile body 1 due to the drag from the speed of the missile body 1. As the device reaches the peak of its ascent, it slows down substantially and spring hinge 37, a very light spring, causes drag lever 41 to move away from missile body 1. This rotates bellcrank 47 about pivot point 59 upwardly and outwardly from the center of the inside of missile body 1 via connecting rod 39, thereby lifting vertical rod 63 which, in turn releases hooks 15, 17, 19 and 21 (see FIG. 3). As this occurs, fins 7, 9, 11 and 13 rotate upwardly about points 23, 25, 27 and 29 and this is shown from the top view in FIG. 5.

Figure 6:
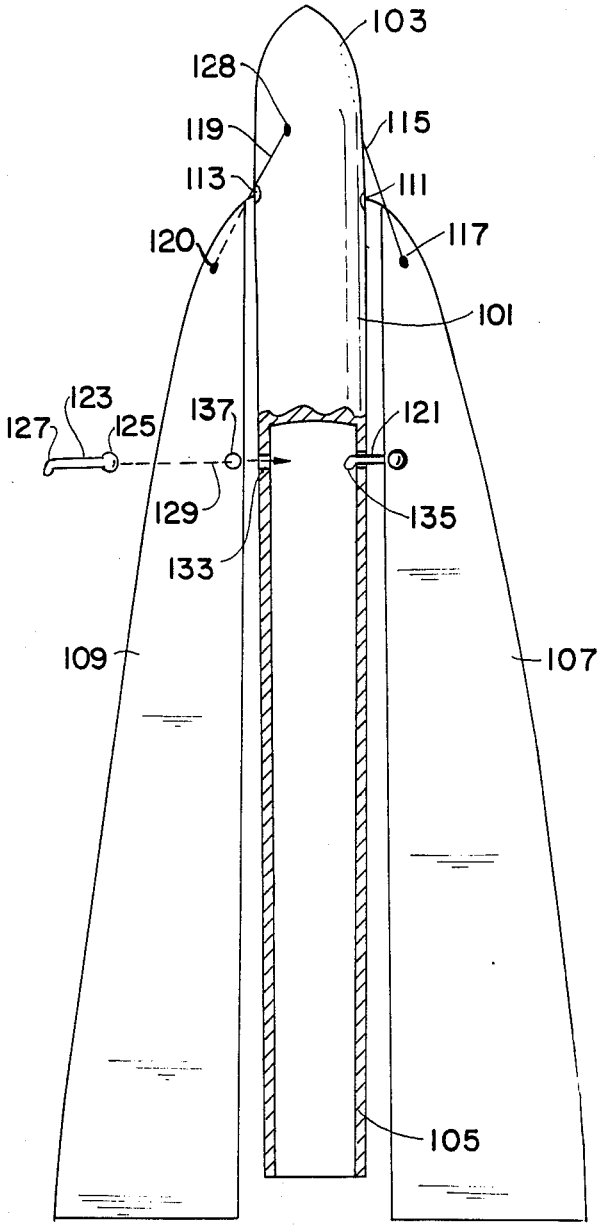

Referring now to FIG. 6, there is shown an alternative embodiment device of the present invention which includes missile body 101, nose 103 and base 105. A plurality of fins, exemplified by fins 107 and 109 are hingedly connected to missile body 101 at its upper half at connecting points 111 and 113. Instead of springs as bias means, this embodiment utilizes elastic strips or elastic bands 115 and 119. Elastic band 115 is connected to fin 107 at point 117 and connected to missile body 101 behind the representation at a point above connecting point 111. This is more fully illustrated in conjunction with fin 109 and elastic band 119 which is connected to the fin 109 at point 120 and to the missile body 101 at connecting point 128 Alternative latch release means are shown which in this case constitute connecting ties 121 and 123. Connecting tie 123 is shown out of its inserted position and arrow 129 shows that it is passed through fin 109 and then through orifice 133 in missile body 101. Basically connecting ties 121 and 123 are string or rod-like pieces which may be made of paper, string, plastic or other burnable or destructible material and contain knobs or insert ends such as is shown in connecting tie 123 having ends 125 and 127 which, after being pushed through fin orifice 137 and missile body 101 orifice 133 will act to hold the fin 109 in its first position. Since this embodiment involves a rocket having a solid fuel compartment, connecting ties 123 and 121 are located within the solid fuel compartment at its upper end such that, at about the time the solid fuel is completely burned up, the connecting ties are burned or deformed at their ends 125 and 135 so that connecting ties will release fins 107 and 109 and they will rotate due to the bias means 115 and 119, into their second position for a helicopter type descent.

Thus, in reviewing FIGS. 1 through 6, it should now be clear to the artisan that the particular propulsion means is not critical to the present invention and may be solid fuel, liquid fuel, catapulting projection, carbon dioxide or other gas propulsion, or any other means which may be employed to propel a missile. Further, the particular latch release means may be of the unique drag lever type which is the preferred type for the toy version of the present invention such as is shown in FIGS. 1 through 4. However, as shown in FIG. 6, other latch release means such as connecting ties could be used. Yet the other alternative latch release means could be used such as the exploding type, radio controlled electromagnetic type, or, any other mechanism which will act to release the fins either automatically by some happenstance within the missile itself, i.e. decrease in aerodynamic drag, set off of a timing device, consumption of fuel or the like, or maybe remotely activated as by a radio signal. Also, the exact configuration of the fins and the number of fins is a matter of choice provided that the fins protrude outwardly in the vertical sence for ascent to create stabilizing fins and move into the second position for a nose up descent with a helicopter type descending effect at about the time or shortly before or after maximum altitude is achieved.

Obviously, numerous modifications and variations of the present invention are possible in light of the above teachings. For example, the bias means may be rubber bands, plastic elastic bands, springs or could even be an integral portion of the top of the fin, e.g. a flexible plastic rod-like extension which is of sufficient length to recoverably bend 90° or so which is unstressed position in the helicopter position. Thus, it is understood that within the scope of the appended claims, the invention may be practiced otherwise than as specifically described herein.

What is claimed is:

1. A missle helicopter device capable of a projected, nose up ascent and a helicopter nose up descent, which comprises:

an elongated missle body having a tapered nose at its top end, and having a base at its bottom end and having a generally upper half and lower half;

a plurality of fins having a longer length than width, said fins being hingedly connected to the upper half of said missle body, said fins having a first position which is a substantially vertical position parallel to said elongated missle body such that said fins protrude along their widths radially outward from said missle body so as to function as flight stabilizing fins during ascent, and said plurality of fins having a second position which is at approximately right angles to said missle body such that said fins protrude radially outward along their lengths away from the upper half of said missle body so as to create a nose up helicopter type rotation during descent;

latch release means located on said missle body which includes a releasable hold mechanism on said plurality of fins to hold said fins in a first position during ascent and to release said fins into said second position during descent, and a drag actuated lever pivotally attached to said body for actuating said latch release means;

bias means located on said missle body and connected to each of said fins so as to bias said fins into said second position upon release by said latch release means from said first position; and, propulsion means to propel said device into ascent.

2. The device of claim 1 wherein said latch means is a bellcrank pivotally attached to an inner portion of said body, a connecting rod connecting said drag actuated lever to one end of said bellcrank, and a vertical rod connected to an opposite end of said bellcrank and extending below the base of said body to connect to said releasable hold mechanism on said fins, wherein air drag during ascent causes said lever to remain in latched position, and air drag on descent causes said lever to pivot, rotating said bellcrank and pulling said vertical rod upwardly, thus releasing said releasable hold mechanism on said fins and allowing said fins to extend to the second position.

3. The device of claim 2 wherein said bias means is elastic strip material.

4. The device of claim 2 wherein said bias means is a spring for each fin.

5. The device of claim 1 wherein said bias means is elastic strip material.

6. The device of claim 1 wherein said bias means is a spring for each fin.

7. The device of claim 1 wherein said second position of said fins forms an angle of at least 100° with the lower half of said missile body.

8. The device of claim 1 wherein said missile body and said plurality of fins are constructed of plastic.

9. The device of claim 1 wherein said missile body and said plurality of fins are constructed of lightweight, thin gauge metal.

10. The device of claim 1 wherein said missile body and said plurality of fins are constructed of lightweight wood.

* * * * *